US006529091B2

(12) United States Patent
Miura et al.

(10) Patent No.: US 6,529,091 B2
(45) Date of Patent: Mar. 4, 2003

(54) ABSORPTIVE CIRCUIT ELEMENT, ABSORPTIVE LOW-PASS FILTER AND MANUFACTURING METHOD OF THE FILTER

(75) Inventors: Taro Miura, Tokyo (JP); Kenji Endou, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/801,793

(22) Filed: Mar. 9, 2001

(65) Prior Publication Data

US 2001/0028281 A1 Oct. 11, 2001

(30) Foreign Application Priority Data

Mar. 13, 2000 (JP) ..... 2000-068555

(51) Int. Cl.[7] ..... H01P 1/22
(52) U.S. Cl. ..... 333/81 A; 333/185; 333/12
(58) Field of Search ..... 333/12, 819

(56) References Cited

U.S. PATENT DOCUMENTS 3,816,673 A * 6/1974 Miya ..... 174/70 S
4,104,600 A * 8/1978 Mayer ..... 333/12

FOREIGN PATENT DOCUMENTS

JP 8-204486 8/1996
JP 8-2044486 * 8/1996

OTHER PUBLICATIONS

F. Uchikoba, S. Nakajima, T. Ito, M, Kobayashi, and T. Miura, "Absorber Chip Provides RF EMI Filtering," Microwaves & RF., vol. 34, No. 2, pp. 69–70, p. 72, Feb. 1995.

Taro Miura and Shiro Nakagawa, "Spectrum Management of Pulse Transmission Line Using an Absorptive High–Cut Filter", Technical Report IEICE., EMCJ2000–78, MW2000–122, pp. 7–12, Oct., 2000.

Taro Miura and Makoto Hasegawa, "Application of Reciprocal and Nonreciprocal Absorption of Ferrite Device in Mobile Telephone System," IMS2000/Workshop/WMD–10, pp. 1–17, Jun. 12, 2000.

* cited by examiner

*Primary Examiner*—Benny Lee
*Assistant Examiner*—Wesley Harris
(74) *Attorney, Agent, or Firm*—Armstrong, Westerman & Hattori, LLP

(57) ABSTRACT

An absorptive circuit element includes a core body made of non-conductive material, an inner conductor formed by winding a conductive wire around the core body with a gap provided between adjacent turns, a magnetic material surrounding outside of the inner conductor, the magnetic material being made of composite material containing ferromagnetic fine metal powder and insulating resin, a dielectric surrounding outside of the magnetic material, and an outer conductor formed on a surface of the dielectric.

17 Claims, 4 Drawing Sheets

ABSORPTIVE CIRCUIT ELEMENT, ABSORPTIVE LOW-PASS FILTER AND MANUFACTURING METHOD OF THE FILTER

FIELD OF THE INVENTION

The present invention relates to an absorptive circuit element and an absorptive low-pass filter, utilizing frequency selective absorption of a magnetic material, and to a manufacturing method thereof.

DESCRIPTION OF THE RELATED ART

In a digital equipment operating at a high clock frequency and in an equipment processing signals with a wide frequency range inside a narrow housing such as a mobile communication equipment, elimination of unnecessary frequency components contained in the signals is important for stabilizing the operation of the equipments.

According to a conventional method for eliminating an unwanted signal, a capacitor with a large capacitance or a general low pass filter was inserted in a source which might produce the unwanted signal to damp unnecessary frequency components in the signal. However, since the large-capacitance capacitor or the general low pass filter was a reactance with a small loss to limit the transmission of the unwanted signal by reflection, the signal reflected by such countermeasure element detoured in other circuits and became new interference sources.

The essential elimination of unnecessary frequency components therefore should not be performed by reflection, but should be performed by absorption.

As for elimination of the unwanted signal by absorption, ferrite beads are currently used. A signal line is covered by the ferrite beads array to configure an inductor with a certain loss so that the unwanted signal is eliminated by the increase in reactance due to frequency and by the magnetic loss. However, since the impedance of the signal line changes depending upon reactance change of the ferrite beads, within a frequency band where the impedance of the ferrite beads is not matching with the output impedance of the unnecessary frequency component source, the unwanted signal is suppressed from passing by reflection. Thus, using of the ferrite beads also cannot be an essential countermeasure. Furthermore, absorption of the ferrite beads rapidly decreases at 1 GHz or more due to performance restriction of the material. Hence, the ferrite beads are insufficient for a countermeasure against the unwanted signal in a recent mobile communication equipment and a high-speed data bus circuit.

In order to solve these problems, the present applicant has proposed an absorptive low-pass filter element exhibiting a small reflection and a large absorption in an unwanted signal processing frequency band (Japanese patent unexamined publication No.08204486A).

FIG. 1 is a partially cutaway oblique view schematically illustrating a structure of this conventional absorptive low-pass filter element.

In the figure, reference numeral 10 denotes a magnetic material core provided in a center section and formed by ferrite or fine powder of pure iron bound with a resin, 11 a conductor (inner conductor) helically wound around the magnetic core 10, 12 a magnetic material provided outside the inner conductor 11 and formed by binding fine pure iron powder with a resin, and 13 an outer conductor formed on the surface of the magnetic material 12 to be made conductive, respectively.

By electrically dividing this outer conductor 13 as shown in FIG. 1 into three sections, by applying a signal across the two conductor sections in both end surfaces (input and output terminals) 13*a* and 13*b* and by grounding the central conductor section (ground conductor) 13*c*, the inner conductor 11 and the outer conductor 13 configure a transmission line with a certain loss. Since this line is distributed-constant structure, a characteristic impedance of the filter element is determined by its line structure and by real parts of a permeability and a dielectric constant of the magnetic material, and loss is determined by the magnetic loss of the magnetic material. If the characteristic impedance is set at a value near to a drive impedance, it is possible to absorb the unwanted signal energy by the loss in the filter element while suppressing reflection from the filter element as much as possible.

When such low pass filter is terminated, as shown in FIG. 2, a reflection coefficient (reflection loss) $S_{11}$ of an input terminal is −10 dB or less over the entire frequency range, but a transmission coefficient (transmission loss) $S_{21}$ exhibits a low-pass or high-cut filtering characteristic. If this filter element is inserted into a high frequency circuit, signals at or below a cutoff frequency will pass as it is, but signals over the cutoff frequency will be absorbed inside the element and will not be transmitted resulting that it is possible to eliminate the signals over the cutoff frequency from the high frequency circuit. If an element other than a terminator is connected to the output side of this filter element however, its impedance is reflected to the input side in a low-pass frequency region of the transmission coefficient $S_{21}$ (Japanese patent unexamined publication No.08204486A).

It is difficult to precisely find a characteristic impedance $Z_0$ of such compact filter element. Nevertheless, by modeling the line structure on a microstrip line, it is possible to roughly calculate the characteristic impedance $Z_0$ from formula (1) with a width $W_0$ of the inner conductor, a thickness h of the magnetic material, and a relative permeability $\mu_r$ and a relative dielectric constant $\in_r$ of the magnetic material.

$$Z_0 = \sqrt{\frac{\mu_r}{\varepsilon_r}}\, 60 ln\left(\frac{8h}{W_0} - 0.358 + \frac{1}{\frac{0.931h}{W_0} + 0.736}\right) \tag{1}$$

Now, let $W_0$ be 0.15 mm, and h be 0.2 mm. Because $\mu_r$=9 and $\in_r$=90 in the magnetic material containing 85 wt % of fine pure iron powder, the characteristic impedance of this filter element becomes $Z_0$=45.2 Ω from formula (1).

However, if such filter element is connected to a drive element with a high impedance, an unwanted signal suppression effect becomes insufficient due to the reflection caused by impedance-mismatching. In addition, if contents of the fine pure iron powder in the magnetic material 12 is increased to enhance the magnetic loss (absorption amount), the input impedance of the element remarkably drops because of the increase of an effective dielectric constant resulting the unwanted signal suppression effect to become further insufficient due to the mismatching in impedance.

If the contents of iron powder is made at 90 wt % or more in the magnetic material 12 in order to increase the magnetic loss, breakdown may occur because of contact between particles of the iron powder and a short-circuit with the ground conductor may occur. This is called a leakage current failure that should be avoided in any electronic component.

SUMMARY OF THE INVENTION

It is therefore an object of the present invention to provide an absorptive circuit element and an absorptive low-pass filter, in which input impedance can be determined independently of an absorption characteristic, and a manufacturing method thereof.

According to the present invention, an absorptive circuit element includes a core body made of non-conductive material, an inner conductor formed by winding a conductive wire around the core body with a gap provided between adjacent turns, a magnetic material surrounding outside of the inner conductor, the magnetic material being made of composite material containing ferromagnetic fine metal powder and insulating resin, a dielectric surrounding outside of the magnetic material, and an outer conductor formed on a surface of the dielectric. An absorptive low-pass filter according to the present invention is provided with this absorptive circuit element.

An absorptive circuit element according to the present invention processes unnecessary frequency components in a signal by absorption, not by reflection. Owing to this, the circuit element of the present invention is remarkably useful for elimination of an interfering wave inside a computer with a high frequency clock and a mobile communication equipment which processes a signal with a wide frequency range in a narrow housing.

Particularly, according to the present invention, in the absorptive circuit element exhibiting a large magnetic loss, an effective dielectric constant of the magnetic material between the inner conductor and the outer conductor or ground conductor is greatly dropped without decreasing its effective permeability by forming the dielectric outside the magnetic material so as to prevent decrease in the input impedance and any leakage current failure from occurring. Thus, the difference between the drive impedance of an unwanted signal source and the input impedance of the absorptive circuit element is decreased to reduce the reflection of the unwanted signal while keeping the attenuation of the unwanted signal, so that the unwanted signal can be effectively eliminated.

In other words, according to the present invention, the input impedance is controlled independently of the absorption inside the absorptive circuit element by dropping the effective dielectric constant between the inner conductor and the outer conductor or ground conductor with suppressing the degradation of the permeability through sandwiching the dielectric between the magnetic material surrounding the inner conductor and the ground conductor. As shown in the formula (1), a line impedance of the absorptive circuit element can be controlled by the permeability and the dielectric constant of a member for supporting the line.

Hereinafter, changes in the permeability and the dielectric constant in case that a dielectric is inserted between a magnetic material and a ground conductor are theoretically calculated.

If a transmission mode in the line is a TEM mode, the law of mapping is established. Hence, the following calculation uses a coaxial line model to obtain an exact solution.

Let the structure of a coaxial line is as shown in FIG. 3, and let a is an inner diameter, b an outer diameter, k an outer diameter of a magnetic material, $\mu_1$ a relative permeability of the magnetic material, $\in_1$ a relative dielectric constant of the magnetic material, $\mu_2$ a relative permeability of a dielectric sandwiched between the magnetic material and a ground conductor, $\in_2$ a relative dielectric constant of the dielectric sandwiched between the magnetic material and the ground conductor, $\mu_0$ a space permeability, and $\in_0$ a space dielectric constant.

In this coaxial line, an inductance per unit length L' is given in formula (2):

$$L' = \int_a^k \mu_0\mu_1 \frac{dr}{2\pi r} + \int_k^b \mu_0\mu_2 \frac{dr}{2\pi r} = \mu_0\mu_1 \ln\frac{k}{a} + \mu_0\mu_2 \ln\frac{b}{k}. \tag{2}$$

Now, let L be:

$$L = \int_a^b \mu_0\mu_1 \frac{dr}{2\pi r} = \mu_0\mu_1 \ln\frac{b}{a} \equiv \mu_1 L_0$$

then, formula (2) is transformed as follows:

$$L' = \mu_1\left[1 + \left(\frac{\mu_2}{\mu_1} - 1\right)\frac{\ln\frac{b}{k}}{\ln\frac{b}{a}}\right]L_0 \equiv \mu_{eff} L_0 \tag{3}$$

and an effective permeability $\mu_{eff}$ becomes as follows:

$$\mu_{eff} = \mu_1\left[1 + \left(\frac{\mu_2}{\mu_1} - 1\right)\chi\right] \tag{4}$$

$$\text{where, } \chi \equiv \ln\frac{b}{k} \Big/ \ln\frac{b}{a}.$$

According to this formula, it can be seen that the effective permeability decreases depending upon a ratio of the inside and outside permeability of the coaxial line. On the other hand, capacitance per unit length of the coaxial line, C' is calculated from a model configured by connecting thin coaxial lines in series:

$$\frac{1}{C'} = \int_a^k \frac{dr}{\varepsilon_0\varepsilon_1 2\pi r} + \int_k^b \frac{dr}{\varepsilon_0\varepsilon_2 2\pi r} = \frac{1}{2\pi\varepsilon_0\varepsilon_1}\ln\frac{k}{a} + \frac{1}{2\pi\varepsilon_0\varepsilon_2}\ln\frac{b}{k}. \tag{5}$$

From formula (5):

$$C' = \varepsilon_1 \frac{1}{1 + \left(\frac{\varepsilon_1}{\varepsilon_2} - 1\right)\frac{\ln\frac{b}{k}}{\ln\frac{b}{a}}} C_0 \equiv \varepsilon_{eff} C_0 \tag{6}$$

Similarly to the case of inductance, let $C_0$ be:

$$C_0 \equiv \frac{2\pi\varepsilon_0}{\ln\frac{b}{a}},$$

an effective dielectric constant $\in_{eff}$ becomes as follows:

$$\epsilon_{eff} = \epsilon_1 \frac{1}{\left(\frac{\epsilon_1}{\epsilon_2} - 1\right)\chi}. \tag{7}$$

Assuming that the dielectric located at the outside is thin, the effective dielectric constant can be approximated as follows:

$$\varepsilon_{eff} \cong \varepsilon_1\left[1-\left(\frac{\varepsilon_1}{\varepsilon_2}-1\right)\chi\right].$$

According to this formula, it can be seen that, although the effective dielectric constant decreases with the thickness of the dielectric, contribution of the dielectric constant of material located in the inside is large differently from the case of permeability.

As used in the former calculation, using $\mu_1=9$ and $\in_1=90$, and selecting a paraelectric material such as plastic as the dielectric, sandwiched between the magnetic material and the ground conductor, it is assumed that $\mu_2=1$, $\in_2=2.5$. Changes of the effective permeability $\mu_{eff}$ and effective dielectric constant $\in_{eff}$ are obtained as follows by inserting the dielectric through substituting this data in formula (7), $$\mu_{eff}=9(1-0.89_x) \quad (8)$$

$$\in_{eff}\cong 90(1-35_x) \quad (9).$$

As is apparent from formulas (8) and (9), the effective dielectric constant $\in_{eff}$ decreases at 39.3 times the speed of the effective permeability $\mu_{eff}$. Therefore, by inserting a paraelectric material with a small dielectric constant between the magnetic material and the ground conductor, it is possible to decrease the effective dielectric constant while suppressing a change of the effective permeability. In addition, even if the insulation of the magnetic material layer is destroyed by the increase of the quantity of iron powder, it becomes possible to prevent current leakage by inserting the dielectric to provide a structure having large freedom in characteristics design.

It is preferred that the outer conductor is located along an axial direction of the absorptive circuit element, and consists of three portions electrically separated from each other.

It is also preferred that the three portions of the outer conductor are electrically separated at locations each ¼ of axial length of the absorptive circuit element distance from each end of the absorptive circuit element in the axial direction.

Preferably, both end portions of the three portions of the outer conductor are electrically connected to both ends of the inner conductor, respectively.

Also, preferably, both end portions of the three portions of the outer conductor function as input and output terminal of the absorptive circuit element, respectively.

Furthermore, preferably, a central portion of the three portions of the outer conductor functions as a ground conductor of the inner conductor.

It is preferred that the magnetic material is a magnetic material exhibiting a frequency selective absorption characteristic, particularly that the magnetic material is a magnetic material exhibiting an absorption characteristic in a high frequency region.

It is also preferred that a width of the inner conductor, a thickness of the magnetic material, a permeability of the magnetic material and a dielectric constant of the magnetic material are determined so that an input impedance in an absorption band does not depend on a frequency in the high frequency region.

It is preferred that a thickness of the dielectric is set so that a reflection characteristic does not depend on an absorption characteristic.

It is further preferred that the dielectric is colored so as to identify the absorptive circuit element.

It is preferred that the core body is made of a ferrite magnetic material, a paraelectric material or a high resistance material.

According to the present invention, also a manufacturing method of an absorptive low-pass filter includes a step of forming an inner conductor by winding a conductive wire around an outer peripheral surface of a core body made of non-conductive material with a gap provided between adjacent turns, a step of surrounding an outer peripheral surface of the core body, around which the inner conductor is formed, with a magnetic material made of composite material of ferromagnetic fine metal powder and insulating resin, a step of forming a bar structure with surrounding an outer peripheral surface of the magnetic material with a dielectric, a step of forming a plurality of separated elemental pieces by cutting the bar structure along planes orthogonal to an axis of the bar structure, and a step of forming an outer conductor on a surface of each separated elemental piece.

It is preferred that the outer conductors are formed by forming a conductive layer over all surfaces of each separated elemental piece and thereafter by electrically separating the conductive layer into three portions located along an axial direction of the core body.

It is also preferred that the conductive layer and both ends of the inner conductor are electrically connected with each other when the conductive layer is formed over all surfaces of each separated elemental piece.

Further objects and advantages of the present invention will be apparent from the following description of the preferred embodiments of the invention as illustrated in the accompanying drawings.

DESCRIPTION OF THE PREFERRED EMBODIMENTS

Figure 1:
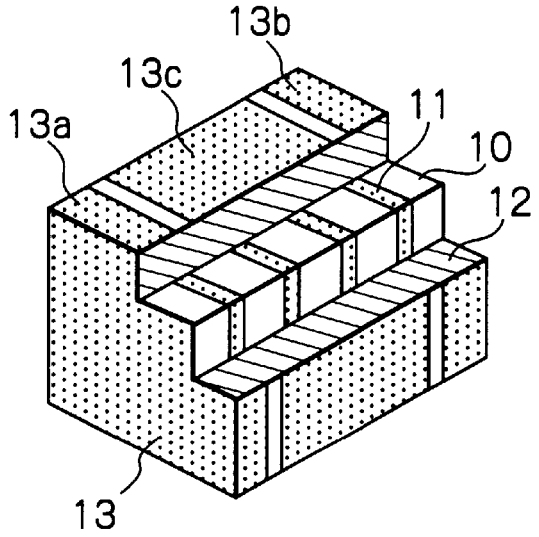
Fig. 1 PRIOR ART
FIG. 1, already described, is a partially cutaway oblique view schematically illustrating a structure of a conventional absorptive low-pass filter element.
Figure 2:
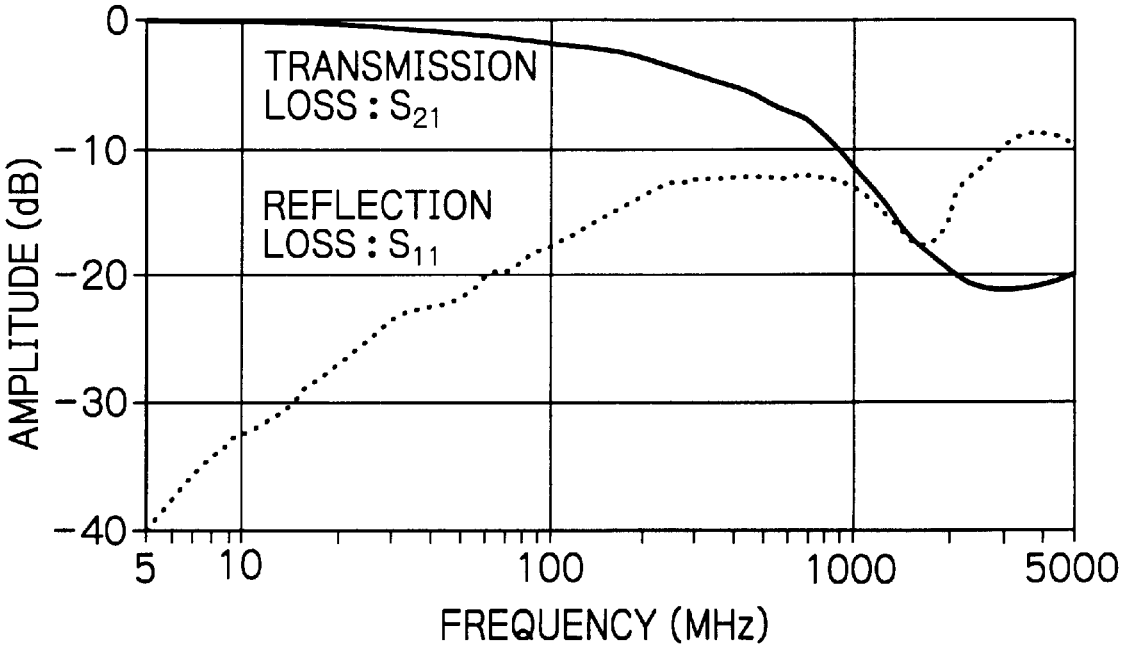
Fig. 2 PRIOR ART
FIG. 2, already described, is a graph illustrating reflection and transmission characteristics of the conventional low-pass filter.
Figure 3:
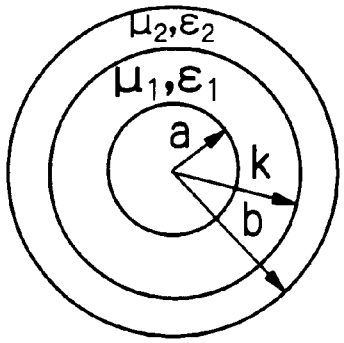
FIG. 3, already described, is a schematic diagram illustrating a coaxial line model according to the present invention.
Figure 4:
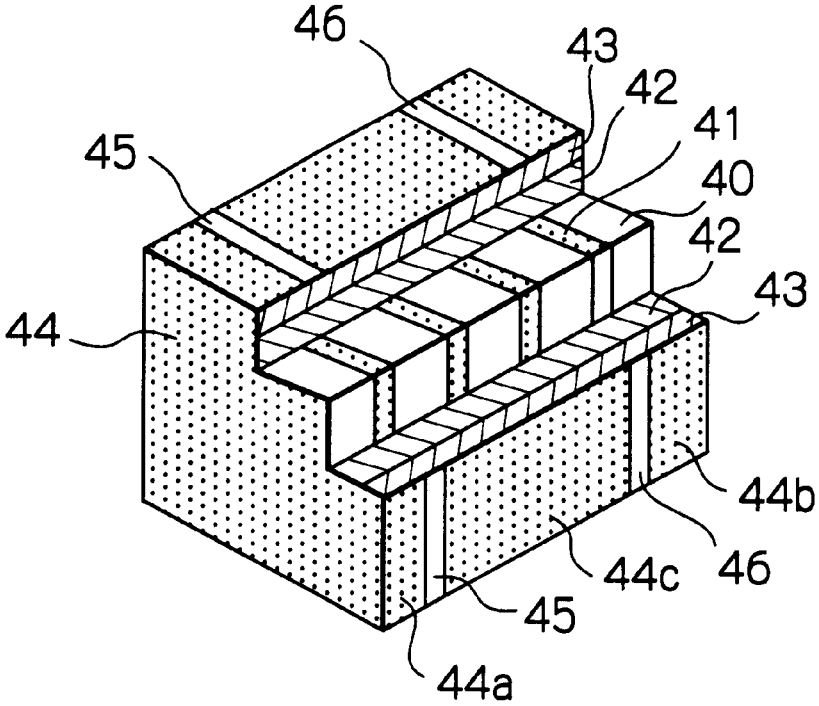
FIG. 4 is a partially cutaway oblique view schematically illustrating a structure of a three-terminal absorptive low-pass filter as a preferred embodiment according to the present invention.

FIG. 4 schematically illustrates a structure of a three-terminal absorptive low-pass filter as a preferred embodiment according to the present invention. Although the filter is illustrated as a stepped shape in this figure due to the partially cutaway view, the absorptive circuit element in this embodiment has an almost rectangular parallelepiped shape.

In the figure, reference numeral 40 denotes a core body provided in a center section and made of non-conductive material, 41 an inner conductor helically wound around the core body 40 with a gap provided between adjacent turns, 42 a magnetic material surrounding the outside of the inner conductor 41 and made of composite material containing ferromagnetic fine metal powder and insulating resin, 43 a dielectric surrounding the outside of the magnetic material 42, and 44 an outer conductor formed on a surface of the dielectric 43, respectively. The outer conductor 44 is electrically separated into three portions by slits 45 and 46 in planes orthogonal to an axis of the core body 40.

These slits 45 and 46 are formed at locations each ¼ of axial length of the absorptive circuit element distance from each end of the absorptive circuit element in the axial direction.

The separated portions of the outer conductor at both ends function as input and output terminals 44*a* and 44*b,* and the central portion functions as a ground conductor 44*c*.

It is desirable to use a magnetic ferrite material as the core body 40. If it is unnecessary to absorb frequency components below 1 GHz, magnetic material formed by binding fine pure iron powder with a resin, paraelectric material or high resistance material may be used for the core body 40. It will be apparent that, so long as the magnetic material 42 is sandwiched between the inner conductor 41 and the ground conductor 44*c,* an absorptive low-pass filter can be configured even if the paraelectric material or high resistance material is substituted for a magnetic material as the core body 40. However, if the core body 40 is made of the paraelectric material or the high resistance material in this manner, the total amount of the magnetic material in the filter will decrease. Thus, a cutoff frequency of the filter will become high and the attenuation of the unwanted signal will be degraded in comparison with a filter with the core body made of a magnetic material.

A preferable shape of the core body 40 is a bar shape such as a square rod or a round rod.

The inner conductor 41 is formed by helically winding a conductive wire around the core body 40 toward the same winding direction as a coil with a gap provided between adjacent turns of the wire. The gaps between the respective turns are provided so as to be large in comparison with the diameter or thickness of the conductive wire, and owing to this, it is possible to ignore an interaction between the turns of the conductive wire. A desirable shape of the conductive wire in its cross section is flat, but can be rectangular, circular, ellipse or any other shape.

The magnetic material 42 is formed by binding ferromagnetic fine metal powder with insulating resin. The particle size of the ferromagnetic fine metal powder is determined on the basis of skin depth that a high frequency magnetic field in a frequency range to be used can enter into particles. The skin depth d of metal is obtained from following formula:

$$d=1/(\pi f\mu\sigma)^{1/2} \tag{10}$$

where f is a frequency, $\mu$ is a permeability of the substance and $\sigma$ is a conductivity of the substance.

Because a high frequency magnetic field permeates into up to the depth being three times the skin depth, enough high frequency magnetic loss will exhibit so long as the particle size of the fine metal powder is around several times the skin depth.

A preferable example of such fine metal powder is fine pure iron powder (carbonyl iron powder) that can be obtained by thermal decomposition of carbonyl iron and has the particle size of less than several micrometers. By binding this iron powder with insulating resin, a substance having high loss at up to a millimeter wave can be obtained. As the ferromagnetic fine metal powder, another ferromagnetic fine metal powder such as nickel or cobalt besides iron can be used. These kinds of metal powder can be used independently or in mixture.

As for the insulating resin for the magnetic material 42, for example, epoxy resin, phenolic resin or rubber resin may be used.

As for the dielectric 43, epoxy resin is preferable, but other thermoplastic resin such as polycarbonate can be used.

The outer conductor 44 is made of nickel which can be formed by electroless plating and has good solderability and weathering resistance, but can be also made of another metal which can be formed by electroless plating such as silver or copper.

Figure 5:
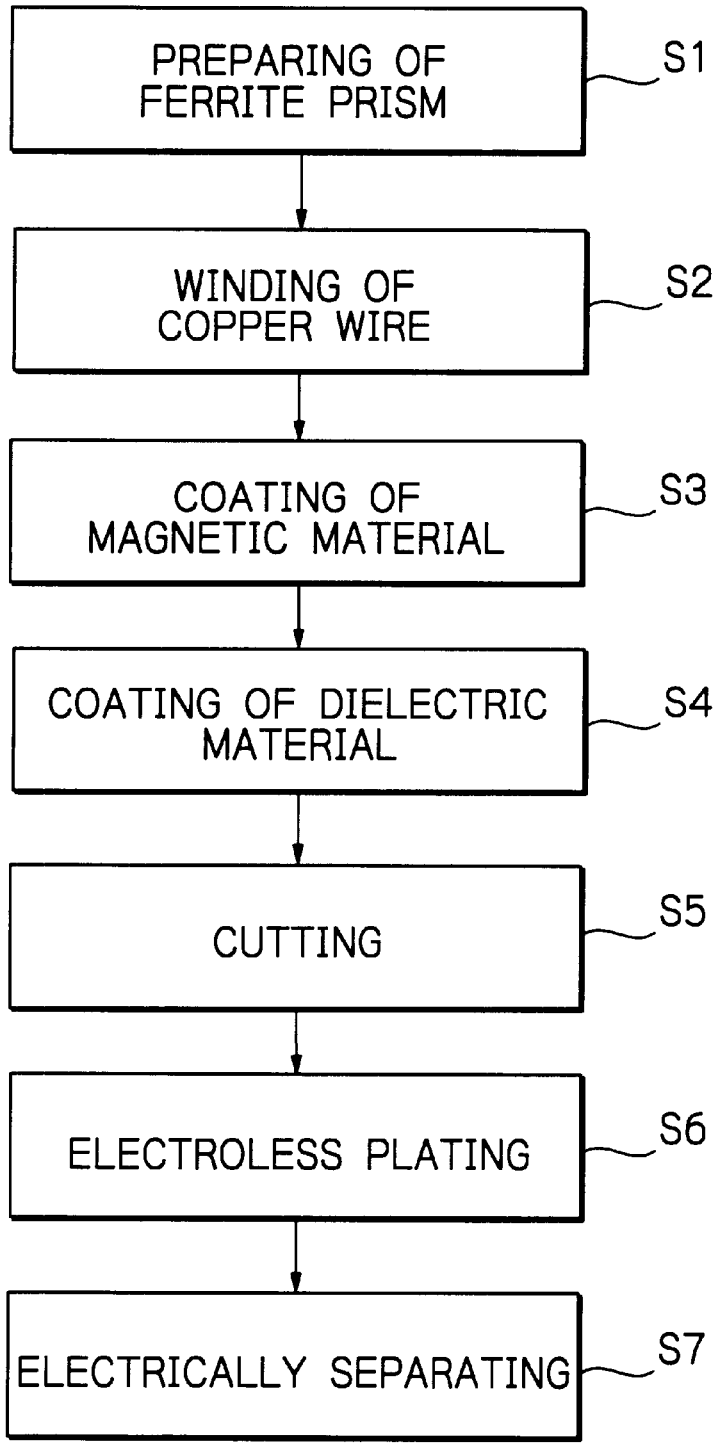
FIG. 5 is a flowchart illustrating a process for actually manufacturing the absorptive low-pass filter in the embodiment shown in FIG. 4.

FIG. 5 illustrates a process for actually manufacturing the absorptive low-pass filter in the embodiment shown in FIG. 4. Hereinafter, a concrete manufacturing example will be described with reference to this figure.

First, as the core body 40, a nickel zinc ferrite rectangular rod or prism of 0.8 mm square is prepared (step S1). Then, a flat copper wire of 0.15 mm wide is helically wound around this prism in 0.2 mm of pitch to as the inner conductor 41 (step S2).

Then, a magnetic material compound composed of 85 wt % of carbonyl iron as pure iron powder in epoxy resin is coated on this inner conductor 41 to form the magnetic material 42 with a thickness of 0.18 mm (step S3). Thereafter, on the outside of the magnetic material 42, epoxy resin as the dielectric 43 with a thickness of 0.02 mm is coated and then a rod structure is formed (step S4).

Next, by cutting this rod structure along the plane orthogonal to its axis, a plurality of separated elemental pieces of 2 mm long are formed (step S5).

Thereafter, the outer conductor 44 is formed by making all the surfaces of each separated elemental piece conductive through applying electroless nickel-plating thereto (step S6). At the time of this electroless plating, both ends of the inner conductor 41 are electrically connected to the plated layer.

Thereafter, a three-terminal filter element is formed by forming the slits 45 and 46 each having a width of 0.1 mm over circumference 0.3 mm apart from both end surfaces of the outer conductor 44 of each elemental piece by ion milling, etching, laser irradiation or the like (step S7).

By forming the slits 45 and 46 after having formed the outer conductor 44 through executing electroless plating to all the surfaces of each separated elemental piece, it is possible to easily form a surface mount type terminal element that is free from the increase of inductance caused by lead lines. Besides, since the connection of the inner conductor 41 and input and output terminals 44*a* and 44*b* are performed automatically in electroless plating, the manufacturing process can be simplified.

The impedance of this filter element can be obtained from the effective permeability and the effective dielectric constant obtained by substituting x=0.1 in formulas (8) and (9). The calculation results in $Z_0$=91.5 Ω, and hence this is impedance suitable for a MOS IC and the like having high driving impedance. Since the permeability is lowered around 9% even by such structure, the insertion loss will decrease from for example 20 dB to nearly 16 dB, and hence a practical problem hardly occurs.

Figure 6:
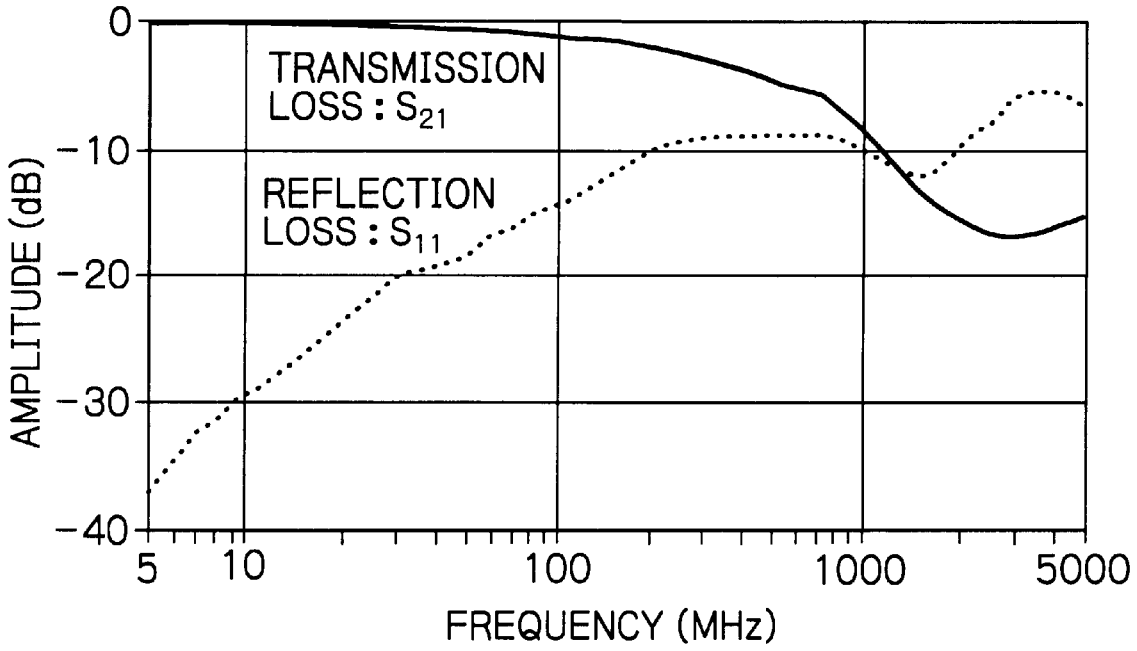
FIG. 6 is a graph illustrating reflection and transmission characteristics of the absorptive low-pass in the embodiment shown in FIG. 4.

Evaluated result in electrical characteristics of this filter is shown in FIG. 6.

Since characteristic impedance of a general high-frequency circuit measuring instrument is 50 Ω, electrical characteristics of the filter whose input impedance is different from 50 Ω may not be correctly measured and in particular regarding the reflective amount characteristics, remarkable error may occur in the measurement. It is verified by calculation that some reflective amount in the measurement result shown in FIG. 6 is derived from the difference between the input impedance of the filter and the characteristic impedance of the measuring instrument. The decrement of absorption balances with the decrement of the total magnetic material amount caused by insertion of the dielectric layer.

It is possible to easily distinguish characteristics of each filter by means of color of the dielectric 43 seen through the slits 45 and 46 if pigments displaying characteristics determined by the thickness of the dielectric and by the ferrite material are added to the resin in the dielectric 43. Such a color code can give a still more practical value to each filter when a plurality of filters having different impedance and cutoff frequencies are mounted on the same substrate.

As described above, according to this embodiment, since the dielectric 43 is inserted between the magnetic material 42 and the ground conductor 44*c*, an effective dielectric constant between the inner conductor 41 and the ground conductor 44*c* decreases greatly. In addition, since the magnetic material 42 is located near the inner conductor 41, the variation of effective permeability is small even if the dielectric 43 is inserted. Therefore, even if content of iron powder in the magnetic material 42 is increased so as to secure an effective absorption characteristic, it is possible to suppress the increase of the dielectric constant of the magnetic material 42, and hence it is possible to suppress the decrease of input impedance caused by the increase of the dielectric constant. In consequence, reflection control in the input terminal becomes very easy. On the contrary, it is possible to produce absorptive low-pass filters whose input impedances are different from each other without changing their absorption amount by adjusting the thickness of the dielectric of each filter.

Such an absorptive low-pass filter is greatly effective, for example, to improve modulation sensitivity by absorbing harmonic waves of an IF local signal as an EMI countermeasure for a PHS terminal, or to stabilize operation by suppressing reflected waves in an non-terminated circuit as the prevention of waveform distortion in a high speed bus line of a computer.

As described above, although the conventional absorptive low-pass filter cannot set reflective amount and attenuation independently, the filter according to the present invention can set reflective amount and attenuation independently by inserting the dielectric having a small dielectric constant between the magnetic material and the ground conductor. Furthermore, the filter according to the present invention can greatly expand a range of applicable circuits by matching the input impedance of this filter with the impedance of each drive source.

Many widely different embodiments of the present invention may be constructed without departing from the spirit and scope of the present invention. It should be understood that the present invention is not limited to the specific embodiments described in the specification, except as defined in the appended claims.

What is claimed is:

1. An absorptive circuit element comprising:

a core body made of non-conductive material;

an inner conductor formed by winding a conductive wire around said core body with a gap provided between adjacent turns;

a magnetic material surrounding outside of said inner conductor, said magnetic material being made of composite material containing ferromagnetic fine metal powder and insulating resin;

a dielectric surrounding outside of said magnetic material, a thickness of said dielectric being set so that a reflection characteristic does not depend on an absorption characteristic; and an outer conductor formed on a surface of said dielectric.

2. The absorptive circuit element as claimed in claim 1, wherein said outer conductor is located along an axial direction of said absorptive circuit element, and consists of three portions electrically separated from each other.

3. The absorptive circuit element as claimed in claim 2, wherein said three portions of said outer conductor are electrically separated at locations each ¼ of axial length of said absorptive circuit element distance from each end of said absorptive circuit element in the axial direction.

4. The absorptive circuit element as claimed in claim 2, wherein both end portions of said three portions of said outer conductor are electrically connected to both ends of said inner conductor, respectively.

5. The absorptive circuit element as claimed in claim 4, wherein both end portions of said three portions of said outer conductor function as input and output terminal of said absorptive circuit element, respectively.

6. The absorptive circuit element as claimed in claim 2, wherein a central portion of said three portions of said outer conductor functions as a ground conductor of said inner conductor.

7. The absorptive circuit element as claimed in claim 1, wherein said magnetic material is a magnetic material exhibiting a frequency selective absorption characteristic.

8. The absorptive circuit element as claimed in claim 7, wherein said magnetic material is a magnetic material exhibiting an absorption characteristic in a high frequency region.

9. The absorptive circuit element as claimed in claim 8, wherein a width of said inner conductor, a thickness of said magnetic material, a permeability of said magnetic material and a dielectric constant of said magnetic material are determined so that an input impedance in an absorption band does not depend on a frequency in the high frequency region.

10. The absorptive circuit element as claimed in claim 1, wherein said dielectric is colored so as to identify the absorptive circuit element.

11. The absorptive circuit element as claimed in claim 1, wherein said core body is made of a ferrite magnetic material.

12. The absorptive circuit element as claimed in claim 1, wherein said core body is made of a paraelectric material.

13. The absorptive circuit element as claimed in claim 1, wherein said core body is made of a high resistance material.

14. An absorptive low-pass filter comprising said absorptive circuit element as claimed in claim 1.

15. A manufacturing method of an absorptive low-pass filter comprising the steps of:

forming an inner conductor by winding a conductive wire around an outer peripheral surface of a core body made of non-conductive material with a gap provided between adjacent turns;

surrounding an outer peripheral surface of said core body, around which said inner conductor is formed, with a magnetic material made of composite material of ferromagnetic fine metal powder and insulating resin;

forming a bar structure surrounding an outer peripheral surface of said magnetic material with a dielectric, a thickness of said dielectric being set so that a reflection characteristic does not depend on an absorption characteristic;

forming a plurality of separated elemental pieces by cutting said bar structure along planes orthogonal to an axis of said bar structure; and forming an outer conductor on a surface of each separated elemental piece.

16. The manufacturing method as claimed in claim 15, wherein said outer conductors are formed by forming a conductive layer over all surfaces of each separated elemental piece and thereafter by electrically separating said conductive layer into three portions located along an axial direction of said core body.

17. The manufacturing method as claimed in claim 16, wherein said conductive layer and both ends of said inner conductor are electrically connected with each other when said conductive layer is formed over all surfaces of each separated elemental piece.

* * * * *